US007370726B1

(12) United States Patent
Chavez

(10) Patent No.: US 7,370,726 B1
(45) Date of Patent: May 13, 2008

(54) LADDER AND CONTAINER COMBINATION APPARATUS

(76) Inventor: Tommy Chavez, 809 San Juan Del Rio, Rio Rancho, NM (US) 87124

( * ) Notice: Subject to any disclaimer, the term of this patent is extended or adjusted under 35 U.S.C. 154(b) by 172 days.

(21) Appl. No.: 11/193,234

(22) Filed: Aug. 1, 2005

(51) Int. Cl.
*E06C 7/00* (2006.01)

(52) U.S. Cl. ..... 182/129; 248/210; 248/238

(58) Field of Classification Search ..... 182/129; 248/210, 238; 206/373; 220/6, 7
See application file for complete search history.

(56) References Cited

U.S. PATENT DOCUMENTS

| | | | | |
|---|---|---|---|---|
| D256,730 | S | 9/1980 | Hester | |
| D286,574 | S | 11/1986 | McMillin | |
| 4,781,300 | A * | 11/1988 | Long | 220/7 |
| 5,370,263 | A | 12/1994 | Brown | |
| 5,641,142 | A | 6/1997 | Hanson et al. | |
| 5,803,254 | A * | 9/1998 | Vasudeva | 206/373 |
| 5,873,433 | A * | 2/1999 | Katz | 182/129 |
| 6,098,748 | A | 8/2000 | Harper, Jr. et al. | |
| 6,138,827 | A * | 10/2000 | Marshall | 206/373 |
| 6,155,444 | A * | 12/2000 | Liu | 220/7 |
| 6,322,177 | B1 * | 11/2001 | Vasudeva | 312/242 |
| 6,382,354 | B2 | 5/2002 | Ahl et al. | |
| 6,467,577 | B1 * | 10/2002 | Charlebois, Jr. | 182/129 |
| 6,513,626 | B2 | 2/2003 | MacSweeney et al. | |
| 7,032,711 | B1 * | 4/2006 | Katz et al. | 182/129 |

* cited by examiner

*Primary Examiner*—Alvin Chin-Shue

(57) ABSTRACT

A ladder and container combination apparatus includes a ladder with a first pair of legs and a second pair of legs hingedly coupled together. A plurality of steps is attached to and extends between the legs of the first pair of legs. A collapsible housing includes a bottom wall that has a first side edge, a second side edge, front edge and a back edge. A back wall is hingedly coupled to the back edge, a front wall is hingedly coupled to the front edge, a first side wall is attached to the first edge, and a second side wall is attached to the second side edge. A support is attached to the housing and to a selected one of the steps. The support is configured to selectively position the bottom wall in a horizontal orientation or in a generally vertical position extending.

4 Claims, 4 Drawing Sheets

LADDER AND CONTAINER COMBINATION APPARATUS

BACKGROUND OF THE INVENTION

1. Field of the Invention

The present invention relates to ladder container devices and more particularly pertains to a new ladder container device which is attached to a ladder in a permanent fashion and which can be selectively positioned in a stored position on the ladder.

2. Description of the Prior Art

The use of ladder container devices is known in the prior art. U.S. Pat. No. 6,098,748 describes a container device that is attachable to a ladder and which includes a tray hingedly attached to the container so that the tray can be pushed out of the way when not in use. Another type of ladder container device is U.S. Pat. No. 6,382,354 which includes a housing having a bracket attached thereto for removably attaching the container to a ladder. Still yet another such device is found in U.S. Pat. No. 5,641,142 which includes a container that is removably attachable to a ladder.

While these devices fulfill their respective, particular objectives and requirements, the need remains for a device that is attached to a ladder in a more permanent manner and which can be selectively folded out of the way when not in use so as to not interfere with the use of the ladder.

SUMMARY OF THE INVENTION

The present invention meets the needs presented above by generally comprising a ladder that includes a first pair of legs and a second pair of legs. The first pair of legs is hingedly coupled to the second pair of legs. A plurality of steps is attached to and extends between the legs of the first pair of legs. A collapsible housing includes a bottom wall that has a first side edge, a second side edge, front edge and a back edge. A back wall is hingedly coupled to the back edge, a front wall is hingedly coupled to the front edge, a first side wall is attached to the first edge, and a second side wall is attached to the second side edge. A support is attached to the housing and to one of the steps. The support is configured to selectively position the bottom wall in a horizontal orientation extending outwardly from the first pair of legs or in a generally vertical position extending upwardly from a juncture of the bottom and back walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
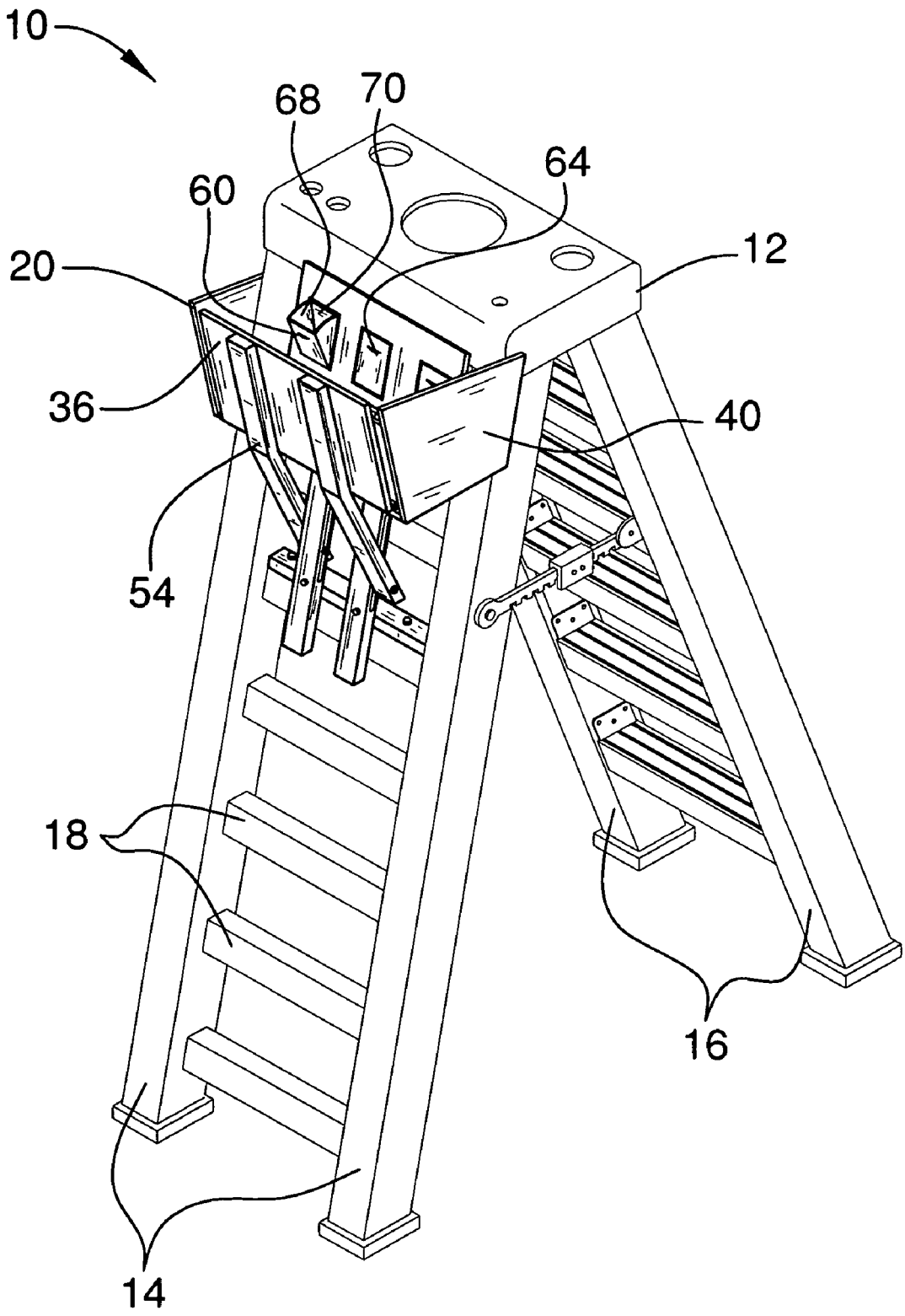
FIG. 1 is a perspective view of a ladder and container combination apparatus according to the present invention.
Figure 2:
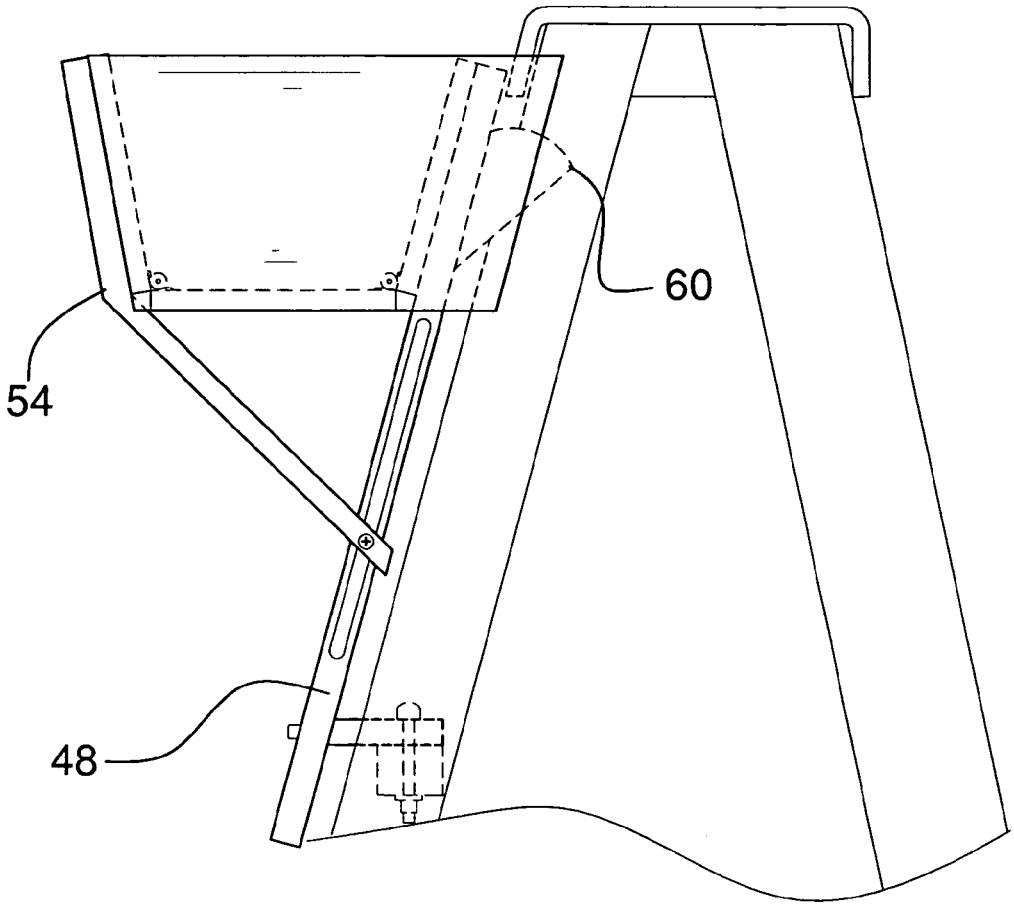
FIG. 2 is a side view of the present invention.

With reference now to the drawings, and in particular to FIGS. 1 through 5 thereof, a new ladder container device embodying the principles and concepts of the present invention and generally designated by the reference numeral 10 will be described.

As best illustrated in FIGS. 1 through 5, the ladder and container combination apparatus 10 generally comprises a ladder 12 that includes a first pair of legs 14 and a second pair of legs 16. The first pair of legs 14 is hingedly coupled to the second pair of legs 16. A plurality of steps 18 is attached to and extends between the legs of the first pair of legs 14. In general, the ladder 12 is conventional in nature.

A collapsible housing 20 includes a bottom wall 22 that has a first side edge 26, a second side edge 28, front edge 30 and a back edge 32. A back wall 34 is hingedly coupled to the back edge 32 and a front wall 36 is hingedly coupled to the front edge 30. A first side wall 38 is attached to the first edge 26 and a second side wall 40 is attached to the second side edge 28. The bottom wall 22 has an opening 42 extending therethrough for receiving tools. The first 38 and second 40 side walls are preferably positioned outside of the first pair of legs 14.

A support 44 is attached to the housing 20 and to a selected one of the steps 18. The support 44 is configured to selectively position the bottom wall 22 in a horizontal orientation extending outwardly from the first pair of legs 14 or in a generally vertical position extending upwardly from a juncture of the bottom 22 and back walls 34. The support 44 includes a horizontal member 46 that is attached to the selected one of the steps 18. A pair of rails 48 is provided. Each of the rails 48 is attached to an outer edge of the horizontal member 46 and is orientated generally parallel to first pair of legs 14. Each of the rails 48 has an upper end 50 and a lower end 52. The lower end 52 extends below the bottom wall 22. The upper end 52 extends above a plane of the bottom wall 22 when the bottom wall 22 is in the horizontal position. The back wall 34 is attached to the rails 48. Each of a pair of arms 54 has first end 56 and a second end 58. Each of the first ends 56 is slidably coupled to one of the rails 48 and is selectively movable upwardly or downwardly along the rails 48. Each of the second ends 58 is attached to the front wall 32.

A plurality of compartments 60 is mounted in the back wall 34. Each of the compartments 60 includes a rear wall 62 and a forward wall 64 attached along their lower edges 66. The rear 62 and forward 64 walls are angled outwardly from each other. Each of the compartments 60 includes a pair of lateral walls 68 extending between and is attached to the forward 64 and rear 62 walls. Each of the compartments 60 is mounted in one of a plurality of apertures 70 extending through the back wall 34. The lower edges 66 are each hingedly coupled to bottom edge of a respective one of the apertures 70. The compartments 60 are selectively extendable outwardly from a first side of the back wall 34 or outwardly from a second side of the back wall 34.

Figure 3:
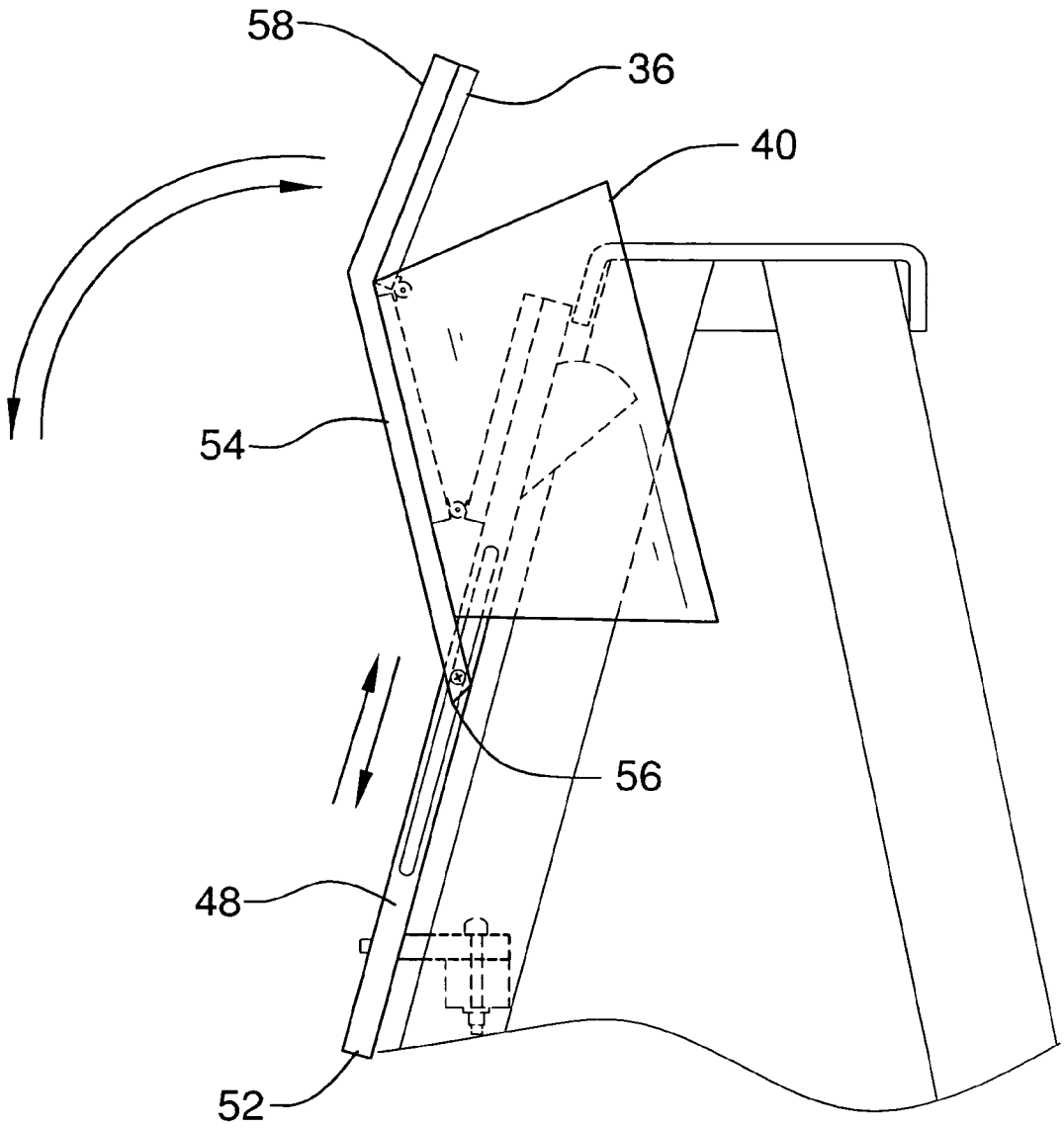
FIG. 3 is a side view of the present invention.
Figure 4:
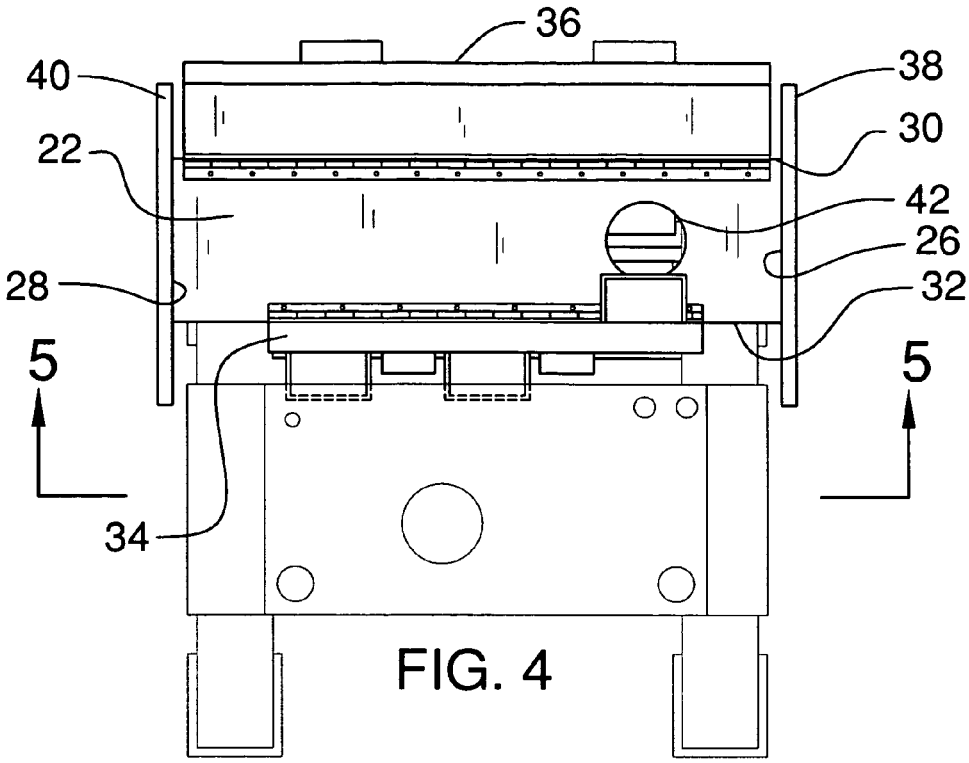
FIG. 4 is a back view of the present invention.
Figure 5:
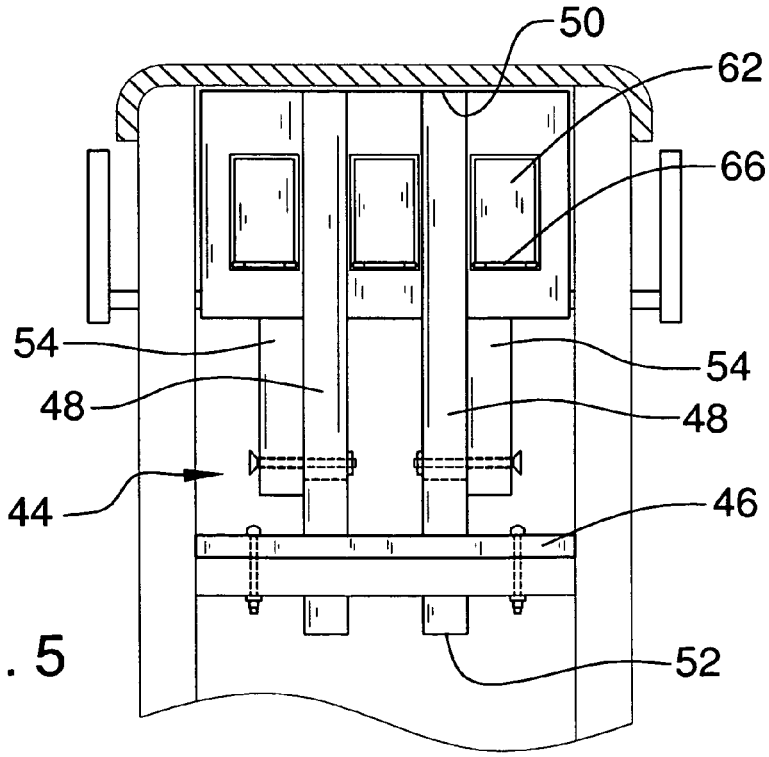
FIG. 5 is a top view of the present invention.

In use, the ladder 12 is used as a conventional ladder 12 while the housing 20 may be used for holding a variety of items. The hinged back 34 and front 36 walls allow the housing 20 to be folded upwardly as shown in FIG. 3. The compartments 68 may be used for holding small fasteners and the like. The compartments 68 are stable when the housing 20 is collapses as the back wall 34 is non-movable with respect to the ladder 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder and container combination assembly comprising:

a ladder including a first pair of legs and a second pair of legs, said first pair of legs being hingedly coupled to said second pair of legs, a plurality of steps being attached to and extending between said legs of said first pair of legs;

a collapsible housing including bottom wall having a first side edge, a second side edge, front edge and a back edge, a back wall being hingedly coupled to said back edge, a front wall being hingedly coupled to said front edge, a first side wall being attached to said first edge, a second side wall being attached to said second side edge; and a support being attached to said housing and to a selected one of said steps, said support being configured to selectively position said bottom wall in a horizontal orientation extending outwardly from said first pair of legs or in a generally vertical position extending upwardly from a juncture of said bottom and back walls;

a horizontal member being attached to said selected one of said steps;

a pair of rails, each of said rails being attached to an outer edge of said horizontal member and being orientated generally parallel to first pair of legs, each of said rails having an upper end and a lower end, said lower end extending below said bottom wall, said upper end extending above a plane of said bottom wall when said bottom wall is in said horizontal position, said back wall being attached to said rails; and a pair of arms, each of said arms having first end and a second end, each of said first ends being slidably coupled to one of said rails and being selectively movable upwardly or downwardly along said rails, each of said second ends being attached to said front wall.

2. The assembly according to claim 1, further including a plurality of compartments being mounted in said back wall.

3. The assembly according to claim 2, wherein each of said compartments including a rear wall and a forward wall attached along their lower edges, said rear and forward walls being angled outwardly from each other, each of said compartments including a pair of lateral walls extending between and being attached to said forward and rear walls, each of said compartments being mounted in one of a plurality of apertures extending through said back wall, each of said lower edges being hingedly coupled to bottom edge of a respective one of said apertures, each of said compartments being selectively extended outwardly from a first side of said back wall or outwardly from a second side of said back wall.

4. A ladder and container combination assembly comprising:

a ladder including a first pair of legs and a second pair of legs, said first pair of legs being hingedly coupled to said second pair of legs, a plurality of steps being attached to and extending between said legs of said first pair of legs;

a collapsible housing including bottom wall having a first side edge, a second side edge, front edge and a back edge, a back wall being hingedly coupled to said back edge, a front wall being hingedly coupled to said front edge, a first side wall being attached to said first edge, a second side wall being attached to said second side edge, said bottom wall having an opening extending therethrough;

a support being attached to said housing and to a selected one of said steps, said support being configured to selectively position said bottom wall in a horizontal orientation extending outwardly from said first pair of legs or in a generally vertical position extending upwardly from a juncture of said bottom and back walls, said support including;

a horizontal member being attached to said selected one of said steps;

a pair of rails, each of said rails being attached to an outer edge of said horizontal member and being orientated generally parallel to first pair of legs, each of said rails having an upper end and a lower end, said lower end extending below said bottom wall, said upper end extending above a plane of said bottom wall when said bottom wall is in said horizontal position, said back wall being attached to said rails;

a pair of arms, each of said arms having first end and a second end, each of said first ends being slidably coupled to one of said rails and being selectively movable upwardly or downwardly along said rails, each of said second ends being attached to said front wall; and a plurality of compartments being mounted in said back wall, each of said compartments including a rear wall and a forward wall attached along their lower edges, said rear and forward walls being angled outwardly from each other, each of said compartments including a pair of lateral walls extending between and being attached to said forward and rear walls, each of said compartments being mounted in one of a plurality of apertures extending through said back wall, each of said lower edges being hingedly coupled to bottom edge of a respective one of said apertures, each of said compartments being selectively extended outwardly from a first side of said back wall or outwardly from a second side of said back wall.

* * * * *